United States Patent [19]

Berggren

[11] 4,073,120

[45] Feb. 14, 1978

[54] APPARATUS FOR REPRESSURIZING TENNIS BALLS

[76] Inventor: Lloyd E. Berggren, 4924 1st Ave. S., Minneapolis, Minn. 55409

[21] Appl. No.: 712,605

[22] Filed: Aug. 9, 1976

[51] Int. Cl.[2] ..... B65B 31/08; A63B 41/12

[52] U.S. Cl. ..... 53/79; 273/61 D; 156/94; 156/145; 53/7

[58] Field of Search ..... 273/61 D, 61 R; 53/7, 53/79; 156/94, 145

[56] References Cited

U.S. PATENT DOCUMENTS

| | | | |
|---|---|---|---|
| 3,699,739 | 10/1972 | Burdwood | 53/7 |
| 3,921,977 | 11/1975 | Brink | 273/61 D |
| 3,929,174 | 12/1975 | Isnardi | 53/7 X |
| 3,974,622 | 8/1976 | Stubblefield | 53/7 |

*Primary Examiner*—George J. Marlo
*Attorney, Agent, or Firm*—James R. Cwayna

[57] ABSTRACT

The method and apparatus for repressurizing tennis balls or other balls not being normally provided with an air fill valve and for internally sealing the same after repressurizing, which includes: a needle-like element for penetrating the skin of the ball and having a passage therethrough for the passing of a sealing medium and air into the ball, compressing the ball to create a negative pressure therein, a sealant containing member which is penetrable by the extending end of the needle element for drawing the sealant into the ball when the compressive force is released and a source of positive pressure which is attachable to the extending end of the needle element for pressure application to the interior of the ball. The sealant is in flowable condition for a period and and will flow about the internal end of the needle to form a supply about the aperture formed by the needle such that when the same is withdrawn, the sealant will flow in and over the aperture to seal the same.

12 Claims, 9 Drawing Figures

APPARATUS FOR REPRESSURIZING TENNIS BALLS

FIELD OF THE INVENTION

This invention relates generally to a method and the apparatus for pressurizing and sealing balls and more specifically, to a method and the apparatus to pressurize and interiorally seal tennis balls such that the exterior surface thereof does not present any outward signs of the pressure introducing means or method.

BACKGROUND AND OBJECTS OF THE INVENTION

At the time of manufacture, tennis balls are pressurized to approximately 10 psi. They are normally packaged in a pressurized, hermetically sealed can to insure that they will be properly pressurized when first put into play. When the balls are exposed to normal atmospheric pressure, the gas inside the balls slowly leaks out and in a few weeks or after a few plays, the balls become "dead" and are at atmospheric pressure. Frequently, the balls become dead before the external surfaces thereof are even minimally worn. With the applicant's method and apparatus, a system for repressurizing dead tennis balls is provided which includes a means for internally sealing the aperture or passage formed in the wall of the ball necessitated when a pressurizing element such as a gas injecting needle penetrates the skin of the ball.

With applicant's device, proper pressurizing of a tennis ball which has gone dead is obtained and the benefits of such method and apparatus should be obvious to anyone who has played tennis. Very often balls are simply thrown away because they have become dead and they do not even find proper use as practice balls. With applicant's concept, these balls may be rejuvenated and at least find use as practice balls even if they would not pass standards necessary for tournament play or the like.

It is therefore an object of applicant's invention to provide a method and the apparatus for repressurizing tennis balls to substantially internally pressurize the same to the standards and pressure to which they were originally manufactured and provided.

It is a further object of applicant's invention to provide a method and the apparatus for pressurizing tennis balls by introducing gas interiorally into the ball and by providing means for internally sealing the aperture formed through the ball.

It is a further object of applicant's invention to provide a method and the apparatus for repressurizing tennis balls and other balls, which require internal pressure, but which normally do not provide filling or pressurizing apertures through the outer skin thereof, by providing a means to introduce gas into the ball and pressurize the same to a first predetermined pressure, and to inject sealant into the ball through the same element as used to pressurize the ball such that a single aperture through the ball may be used to pressurize and introduce the sealant therein.

It is a further object of applicant's invention to provide a method and the apparatus for penetrating the skin of a tennis ball or the like for the introduction of gas therein for repressurizing thereof and thereafter or prior thereto introducing a sealant into the ball for sealing of the aperture internally of the skin of the ball.

It is still a further object of applicant's invention to provide a method and the apparatus for automatically repressurizing tennis balls and the like by providing a means for automatically predetermining and controlling internal pressure of the ball and thereafter introducing a sealant into the ball to flow about the gas injecting member and to cover the aperture formed theregy after removal of the injecting member.

It is still a further object of applicant's invention to provide a method and the apparatus for automatically repressurizing and internally sealing at least one tennis ball or the like which includes means for compressing the ball, penetrating the skin of the ball, injecting air or gas into the ball to a predetermined pressure and injecting a predetermined amount of sealant interiorally of the ball for sealing about the injecting member and about and over the aperture formed thereby after removal of the injecting means such that the ball is returned in an apparent unaltered condition.

These and other objects and advantages of the invention will more fully appear from the following description made in connection with the accompanying drawings in which the same numeral is used to designate the same or similar parts throughout the several views, and in which:

FIG. 3 is a perspective view of a manual device providing the concepts of applicant's invention for the repressurizing and internal sealing of a tennis ball or the like;

FIG. 7 is an elevation of the method and the apparatus utilized by applicant in the automatic operation of a repressurizing and internal sealing concept for tennis balls or the like;

In accordance with the accompanying drawings, the various forms for practicing the methods of applicant's invention include certain basic steps. These steps are illustrated in their simplest form in FIG. 1 which illustrates the method being practiced through a hand operation.

In this particular form and in all of the other remaining forms, the ball B is of the type which may be termed a continuous skin ball, initially pressurized to a predetermined pressure. By continuous skin, it is meant that no accommodation is provided for refilling or repressurizing the ball. This term, continuous skin, contrasts a football or basketball to a tennis ball.

Figure 1:
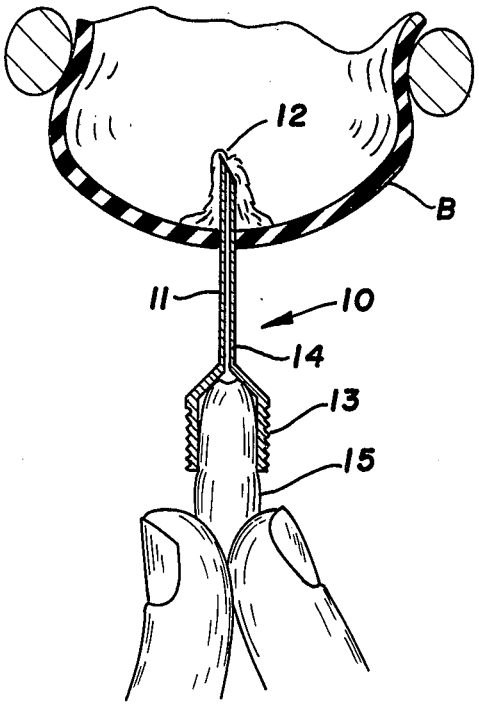
FIG. 1 is a view of a tennis ball and a gas injecting and sealing injecting element associated therewith for the practice of applicant's invention through a hand operation.

In the structure and method illustrated in FIG. 1, an injector or penetrating element, such as a hollow needle, generally designated 10 is provided, which element, in the form shown, includes a generally longitudinally extending penetrating portion 11 having a sharpened end 12 with a connection end 13 opposite the penetrating end 12 which is shaped to be of a larger diameter than the penetrating end 12. Connecting the end 13 and penetrating end 12, a passage 14 is provided entirely through the member 11 for the introduction of gas and sealant therethrough. In the particular form shown in FIG. 1, the needle 10 is shown inserted into a ball B and fingers of a hand are illustrated as applying pressure to a sealant containing capsule 15 and fingers of another hand are illustrated as compressing the ball. The purpose of compressing the ball is to provide a negative pressure, i.e. below atmospheric, after release of such compressing force so the introduction of sealant and gas is easily achieved. The compressing may take place prior to or after penetration of the ball by the needle. The sealant containing capsule, in this particular form, and in the form illustrated in FIGS. 3 through 6, comprises a rupturable or penetratable outer skin containing the sealant therein such that the sealant may be forced therefrom upon the application of pressure.

Capsule 15 is preferably deformable such that, as shown in FIG. 1, the capsule may be received into the connection end 13 of the injector and penetrating element 10 and conform thereto such that upon the application of pressure to the capsule 15, the sealant will be squeezed therefrom and will pass through the passage 14 to the interior of the ball B. This flow is aided by the negative pressure obtained by the prior compression. The sealant utilized in this application is a flowable sealant and must, of course, be compatable with the interior surface of the ball B to adhere thereagainst and cover the aperture formed by the injector and penetrating needle 10 after the same is removed.

In the form shown in FIG. 1, the injector and penetrating needle 10 is inserted upwardly into the ball such that when the sealant is provided to the member 10, it will flow upwardly assisted by squeezing the capsule and the negative pressure within the ball, over the open end of the injector and penetrating needle 10 and flow downwardly therearound to form a puddle about the member when the same is in the ball and which will therefore flow downwardly over the aperture formed by the member when the same is removed from the ball.

As will be obvious from the continued description of the method, the introduction of the sealant and the pressurizing gas may take place in either sequence although if the gas is initially introduced, the compression of the ball is unnecessary. An advantage in introducing the sealant through the injector and penetrating needle 10 first is utilization of the negative pressure from compressing and that the introduction of gas thereafter will force sealant therefrom and clear the introduction passage 14 of any sealant. If the sealant were introduced subsequent to the introduction of gas, it should be obvious that a certain amount of sealant could remain in the passage 14 and hamper future use of the unit.

Utilizing either of the methods of sequential operation, then, prior to or after the introduction of gas to the ball B through the injector and penetrating needle 10, the rupturable capsule 15 containing the sealant is placed in position to transfer the sealant through the passage of the needle 10.

A differential pressure must be established which will cause the sealant to flow from the capsule through the penetrating needle into the ball. This differential pressure can be created either by squeezing the capsule, squeezing the ball prior to inserting the exterior end of the penetrating needle into the capsule and releasing the ball after the penetrating needle has been inserted into the capsule or by a combination of these methods.

After the gas and sealant, by either process has been introduced, the needle 10 is removed and the sealant will flow over and cover the passage that has been formed by the introduction of the needle 10. When utilizing the structure of FIG. 1, a simple pressurizing device such as a hand air pump or the like may be utilized by attaching the same to the enlarged threaded end **13*a* of the needle 10 to increase the internal pressure of the ball to approximately 10** psi.

Figure 2:
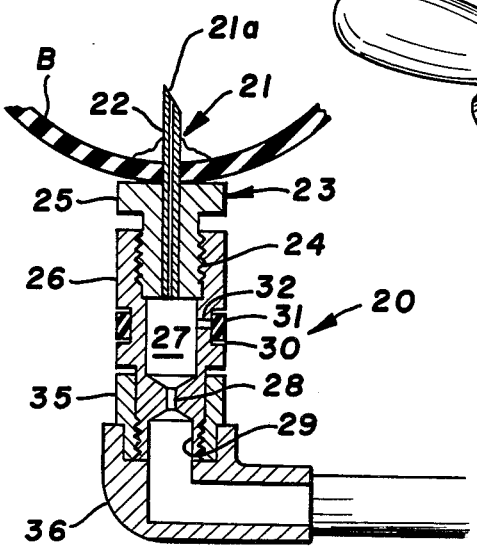
FIG. 2 illustrates a first form of an injector and penetrating element for injecting gas and sealant into a tennis ball or the like for repressurizing and internally sealing thereof.

The structure of FIG. 2 again provides a means for filling a ball B to a predetermined pressure and includes the utilization of an air pressure limiting device. The sealant and air introduction unit is designated 20 and, in the form shown, includes a longitudinally extending injector and penetrating needle element 21 sharpened on one end **21*a* thereof and having a passage 22 formed therethrough. This needle 21 extends through a first receiving block 23 which may be cylindrical in shape and longitudinally extending to have a threaded portion 24 on one end thereof of a smaller diameter than a shoulder portion 25 on the other end thereof. This shoulder portion will serve as a stop element for insertion of the needle 21 into the ball and the needle 21 is sealingly secured generally centrally of the shoulder member 23. In the form shown, a pressure limiting member 26 is threadably received upon the threads 24 of the block 23 and provides a longitudinally extending body having a cavity 27 therein with a restrictive opening 28 extending longitudinally to a material receiving end 29 thereof. Receiving end 20** is externally threaded for the placement of various elements thereon and thereagainst.

Arranged generally peripherally about the cavity 27 is an annular groove 30 having an elastomer ring 31 housed therein and a communication passage 32 extends from the cavity 27 to the groove 30.

The concept of this relief communication passage and the elastomer ring 31 contained in the groove 30 is to provide a pressure relief to control the introduction of gas into the ball to a predetermined level. By particularly selecting the proper combination of the elastomer and ring size, when the pressure being transferred to the ball and therefore in the cavity 27 reaches the desired pressure, the ring will be forced from sealing contact with the passage 32 and the ball will be maintained at the proper pressure.

As stated, the enlarged open end or material receiving end 29 of the unit 20 is designed to receive an air pump connection or the like, which, in the form shown, may include a threaded head assembly 35 attachable to any form of gas supply nozzle or the like. The particular opening 29 of the receiving element 20 will accommodate the sealant containing capsule either prior to or after the nozzle 36 has been received thereon to introduce gas or air into the ball. Obviously with the structure shown in FIG. 2, it would be beneficial to introduce the sealant into the ball prior to the delivery of gas thereto. This procedure would insure that the introductory passage 22 through the introduction member 21, would be cleared of sealant prior to its next use.

With this form of the invention, the ball would be compressed prior to needle insertion or after needle insertion and prior to the capsule introduction.

A first mechanical form for the inflation and repressurizing of balls is illustrated in FIGS. 3, 4, 5, and 6. In this particular form, the applicant's device includes what may be termed a mechanical pump designated in its entirety 40. The pump includes a compressable flexible and resilient gas retaining, longitudinally extending envelope 42 having the introductory needle apparatus 43 on one end thereof and being provided with a rolling, pumping mechanism 44 designed to compress the envelope 42 and force the gas therein upwardly or longitudinally thereof into the ball B and thereafter force a sealant containing capsule onto the introductory needle element 43 for the penetration thereof and the ultimate introduction of sealant into the ball B.

In the form shown, the envelope 42 comprises an open ended longitudinally extending, generally circular gas retaining element having an open end 45 with the penetrating and introduction needle 43 sealingly arranged on the opposite end thereof.

Figure 3:
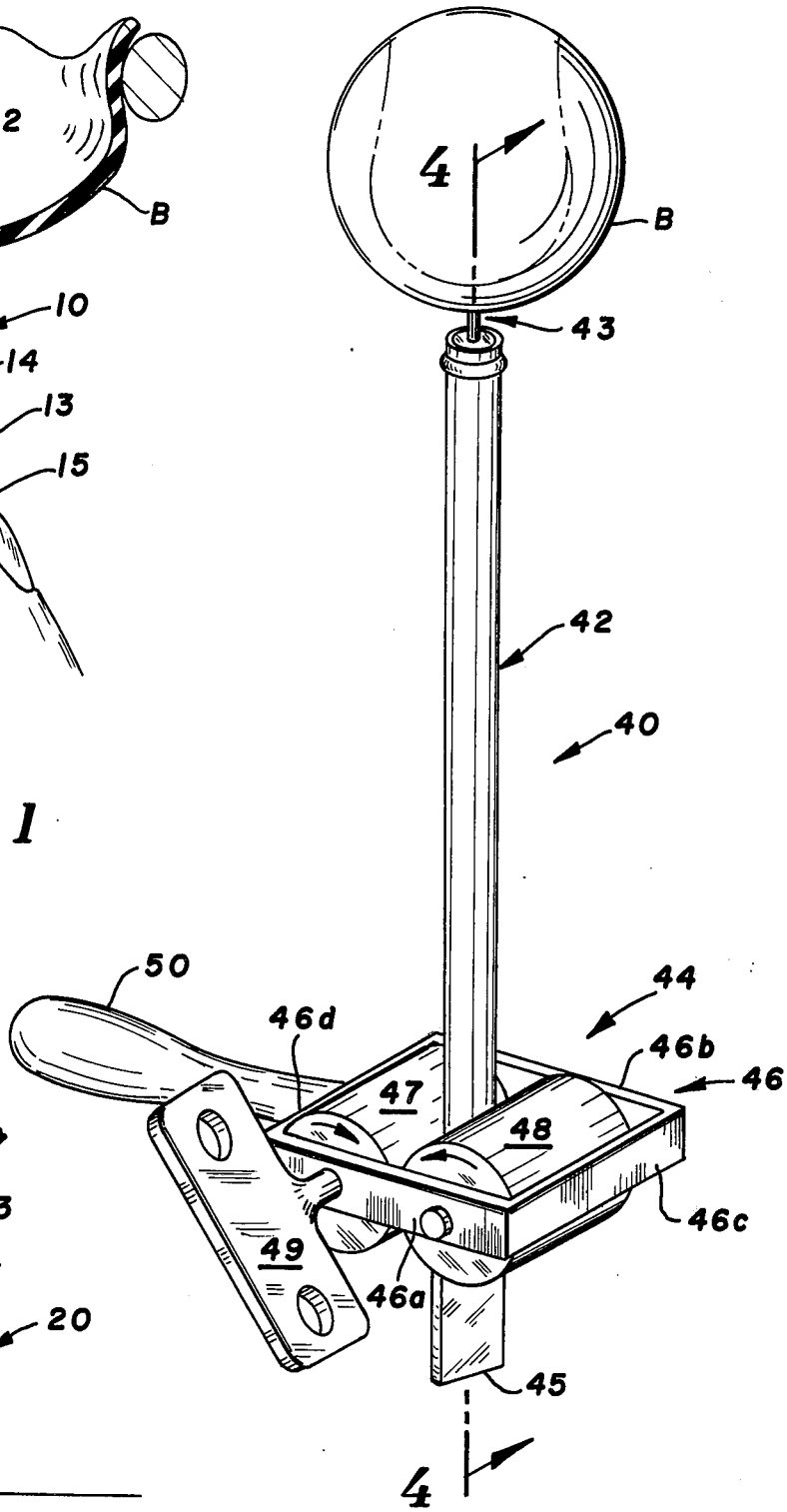

The length and diameter of the envelope 42 may be calculated to insure that the ball B will be pressurized to its proper predetermined pressure upon total collapse thereof and the means for collapsing the envelope 42 and ultimately collapsing the sealant capsule is best illustrated in FIG. 3.

As shown therein, the pump 44 consists of a generally rectangular framework 46 having a pair of spaced sides 46*a*, 46*b* and spaced end elements 46*c*, 46*d* provided for pivotally mounting a pair of roller members 47, 48 therein. These roller members 47, 48 are pivotally mounted on axles through the sides 46*a*, 46*b* of the mounting frame structure, and a turning T, 49, or the like, is provided to engage one of the axles of the rollers 47, 48 for rotation thereof. A handle member 50 is attached to one end 46*d* of the frame 46 for holding the same while operating the key and rollers to collapse the envelope 42. Obviously, as the rollers and the frame structure 46 will advance along the envelope, thus forcing the air therein through the introductory needle device 43 and into the ball B.

The introductory needle includes a longitudinally extending needle element 51 having a penetrating end 52 to be received interiorally of the ball B and a passage 53 is provided through this needle 51 for the passage of air and sealant from the envelope area into the ball B. A mounting and sealing structure 54 is provided in spaced relation from the penetrating end 52 of the needle 51 and the needle 51 is secured therein. This mounting element 54 is substantially cylindrical in shape to be received into the cylindrical envelope 42 and a peripheral ring 54*a* is formed around the exterior thereof to provide a positive seal for capturing the envelope therearound. Mounting element 54 tapers to an entrance end 55 and a peripheral slot 56 is formed therein adjacent this end. This particular slot could take the form of a simple aperture or passage directed inwardly of end 55, the purpose of which is to provide a capturing area for a retaining clip member 57 which is designed to retain the sealant containing capsule and also to allow the compression and collapsing thereof onto the extending end 58 of the needle member 51. As shown, this end 58 is also sharpened to assist in penetration of the capsule 59.

Figure 4:
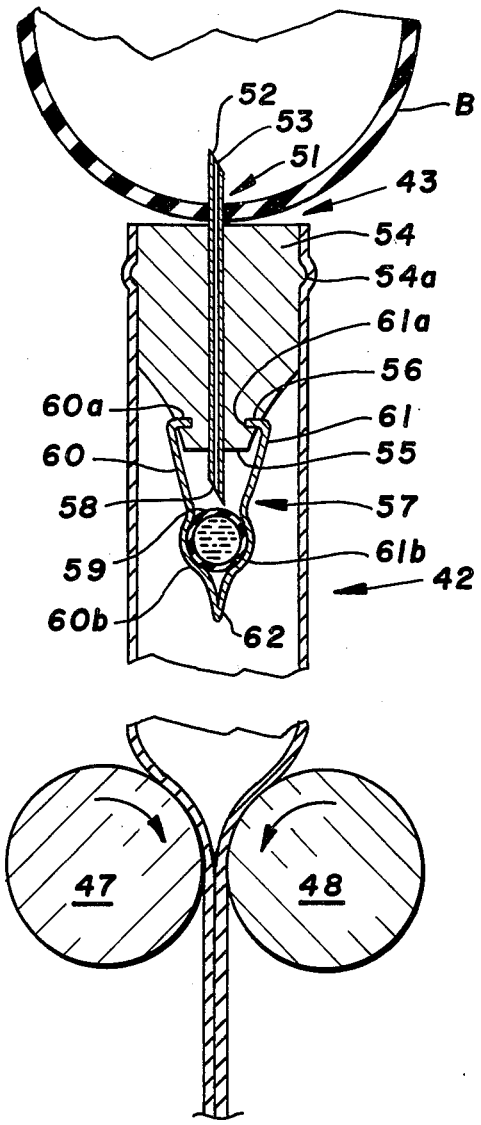
FIG. 4 is a vertical section taken substantially along Line 4—4 of FIG. 3 illustrating the elements of FIG. 3 in a gas injecting condition.
Figure 5:
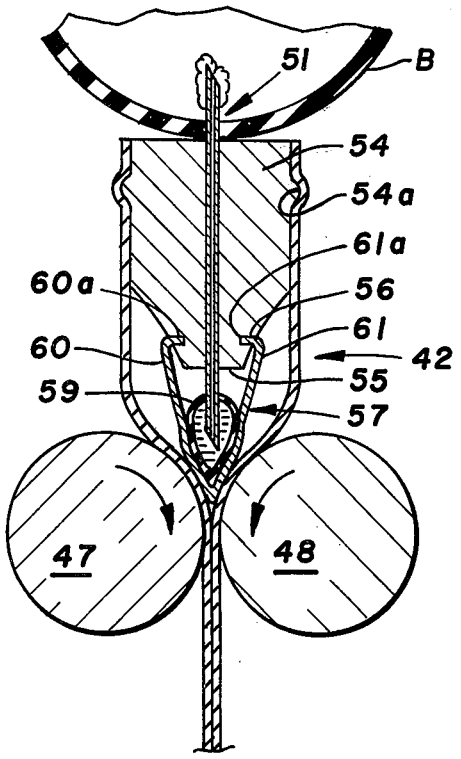
FIG. 5 is a view similar to FIG. 4 illustrating the unit of FIG. 3 in postion to inject sealant interiorally of the ball.
Figure 6:
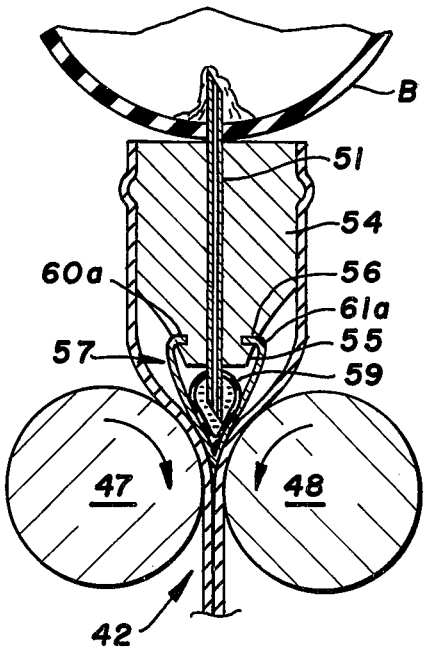
FIG. 6 is a view similar to FIG. 5 in a progressive stage of sealant introduction into the tennis ball.

The clip 57 may be of formed wire or may be another formed body which will provide a capturing device which will position the capsule 59 in position with respect to the sharpened point 58 of the needle member 51 and may include, as in the form shown, a device having a pair of leg members 60, 61 having inwardly directed extensions 60*a*, 61*a* to be received into the aforementioned passage 56 and the leg members 60, 61 joining at a common point 62 with a portion of the legs being formed or spaced as at 60*b*, 61*b* to facilitate the insertion and holding of a sealant capsule therebetween. The concept of the pump device is to force air upwardly through the envelope 42 by the advancement of the rollers thereon as illustrated in FIG. 4 and upon the rollers meeting the capsule 59, to force the same into puncturing relationship to the sharpened end 58 of the needle injection member 51 such that upon further compression or further movement of the rollers 47, 48, the sealant will be squeezed from the capsule 59 upwardly into the ball B as particularly illustrated in FIGS. 5 and 6. After complete delivery of the sealant to the ball, the pump device is removed from the ball and the sealant will flow over the aperture formed therethrough to seal the same. This particular arrangement provides a hand operated device for insuring the delivery of a quantity of air to properly pressurize the ball and thereafter to provide the sealant into the ball for sealing of the aperture formed therein upon retraction of the injection member.

With this structure, the gas or air is introduced to the ball prior to the sealant and compression of the ball to create the negative pressure would be of no assistance to the entire operation.

Figure 7:
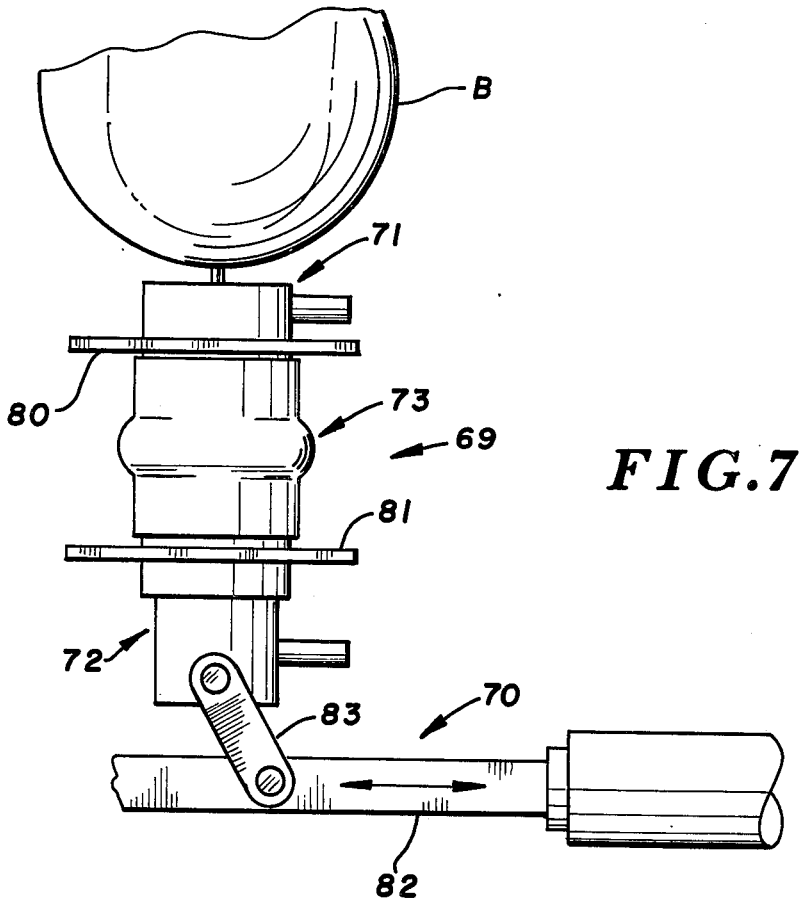
Figure 8:
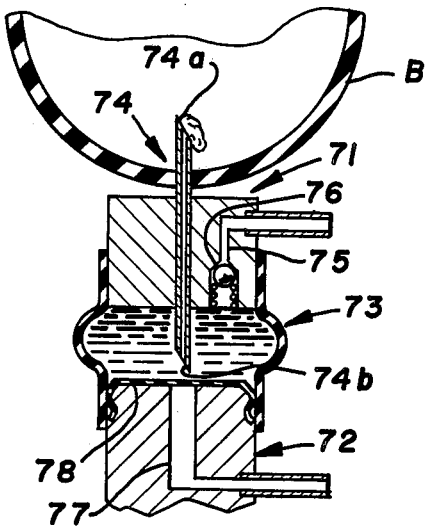
FIG. 8 is a vertical section taken substantially along a central axis of the device illustrated in FIG. 7 and illustrating the same in a sealant injecting position; and, FIG. 9 is a view similar to FIG. 8 and illustrating the unit in a position to allow gas or air to flow therethrough.
Figure 9:
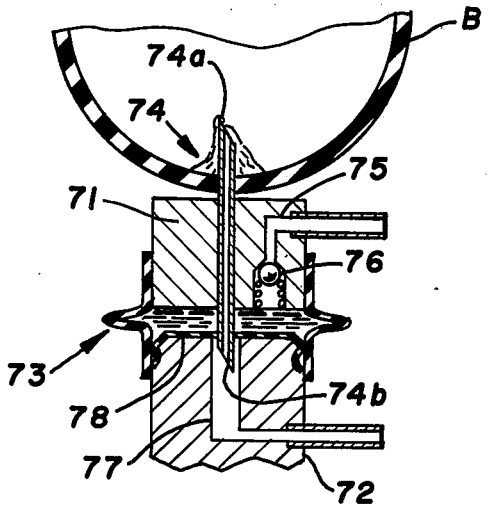

As illustrated in FIGS. 7, 8 and 9, a mechanical device which may be adapted to automatic operation is provided for the filling of tennis balls or the like. This device would be operable as, for example, a coin operated vending machine for filling either single or a plurality of balls through an automatic arrangement.

In the form shown, the unit includes an entire injecting unit designated 69 with a drive mechanism and operating mechanism designated 70. The injector unit includes a pair of spaced body members 71, 72 joined through a flexible diaphragm member 73. The upper body member 71 includes the injection and penetrating needle 74 having a sharpened, delivery end 74*a* and a sharpened, receiving end 74*b* at the opposite end thereof which end 74*b* is of a length, in combination with the flexible diaphragm 73 and the movement thereof to be positioned between the upper body 71 and the lower body 72 in the cavity therebetween in a first position and to extend into the lower body 72 in a second position of the unit. The upper body 71 includes a sealant inlet passage 75 controlled by a check valve 76 to permit the introduction of sealant into the cavity defined by the body members 71, 72 and the compressible diaphragm 73.

The lower body member 72 includes an air inlet and outlet passage 77 which is arranged to be in alignment with the receiving end 74*b* of the needle 74. This passage is arranged for the introduction of air thereto or the release of air therefrom and means for valving the same must be provided but are not shown. A closure diaphragm 78 is provided to normally overlie the inwardly disposed end of the body member 72 and normally to cover the air inlet passage 77 to prevent air flow into the sealant area between the body members 71 and 72.

As illustrated in FIG. 7, the upper body member 71 is arranged on a mounting flange 80 and the lower body member 72 is arranged on a mounting flange 81 with the driving section 70 arranged to move the lower body member 72 upwardly through a cam member 83 such that the lower body will be shifted upwardly to decrease the volume of the sealant area to force sealant through the needle injector device through a certain portion of the stroke and thereafter, upon continued movement of the lower body upwardly, to drive the injector member through the diaphragm 78 and present air from passage 77 to the needle 74.

The drive mechanism 70 includes a reciprocating drive shaft 82 attached to camming member 83 such that as the reciptocating shaft 83 is moved from side-to-side, the camming member 83 will shift the lower body member upwardly and downwardly. Obviously, means must be provided to permit the lower body 72 to move through the mounting plate 81.

The operation of this mechanical aspect of applicant's invention would be obvious to those skilled in the art. Initially the unit 69 is in the position of FIG. 9 where the injector member communicates with the interior of the ball and the air passage in the lower body member. This could be termed an initial and a final position. The sealant shown within the ball in this Figure would be placed therein after a full cycle and therefore represents the final position of the unit. With this communication and the valving for the air passage, it should be obvious that the compression of the ball may take place after the ball is properly placed on the upper end of the needle injector. At this point of operation, the sealant cavity is compressed. If the ball has been precompressed, it will be held in this condition until the camming mechanism has shifted the lower body member to the position as shown in FIG. 8. At this time the compressing force is removed from the ball and a negative pressure will exist therein to assist with the injection of the sealant. During the downward movement of the lower body, sealant is drawn into the cavity through passage 75 and valve 76 and the receiving end of the injector needle is positioned to receive the same due to the negative pressure and subsequent upward movement of the lower body. Continued upward movement of the lower body will again force the end **74*b* of the injector needle through the diaphragm 78 and place the same into the air passage 77** to permit the introduction of pressurized air or gas into the ball. This introduced air or gas will clear the needle of sealant.

When the ball pressure reaches the desired level, the ball is removed from the delivery end **74*a*** of the injector needle and the sealant will cover the aperture provided by the needle and seal the air or gas within the ball.

With this mechanical method, it should be ovvious that many sequential arrangements of operation may be used which include or which do not include the precompression of the ball.

With applicant's method and apparatus, a means for introducing pressurizing gas and a sealant interiorally of a tennis ball or similar ball is provided wherein the method and apparatus basically includes an injector device which will allow the introduction of sealant and gas sequentially into the interior of the ball with the method and the apparatus being expanded upon the desire of the user to either utilize a separate pump, a built-in pump or an automatic unit.

What I claim is:

1. The apparatus for repressurizing balls having a continuous exterior skin including:

a longitudinally extending injecting and penetrating element having one end thereof arranged to penetrate the exterior skin of the ball and having the other end arranged and constructed to receive a supply of pressurized gas and a supply of sealant;

a passage through said injecting and penetrating element for communication between said ends;

means for compressing the ball to expel the air therefrom through said injecting and penetrating element for the building of a negative pressure therein;

sealant supply containing means having a supply of sealant therein and having an exterior skin penetrable by said other end of said injecting and penetrating element for the delivery of sealant therethrough upon penetration thereof and release of the negative prewithin the ball; and, means for providing pressurized gas through said injecting and penetrating element upon removal of said sealant supply.

2. The apparatus as set forth in claim 1 and said sealant supply means including a rupturable exterior covering providing a containing capsule and a supply of sealant of a flowable form contained therein.

3. The apparatus as set forth in claim 1 and pressure relief means associated with said injecting and penetrating element opening upon the internal pressure of the ball reaching a predetermined level.

4. The apparatus as set forth in claim 1 and said means for providing pressurized gas including a compressable envelope having an outlet attachable to said other end of said injecting and penetrating element and means for compressing said envelope to force the gas therefrom.

5. The apparatus as set forth in claim 4 and said compressable envelope being longitudinally extending and said compressing means including a pair of roller members arranged in side by side relation to position said envelope therebetween and means for rotating at least one of said rollers whereby said rollers will advance longitudinally along said envelope to force the gas therefrom.

6. The apparatus set forth in claim 4 and said sealant supply being arranged interiorally of said envelope adjacent said injecting and penetrating element, said compressing means arranged to force said sealant into and through said injecting and penetrating element.

7. The apparatus as set forth in claim 1 and said other end of said injecting and penetrating element arranged and constructed with a penetration portion.

8. The apparatus as set forth in claim 1 and:

a housing providing a cavity therein, said injecting and penetrating element extending through said housing having the penetrating end extending exteriorally therefrom with said other end being arranged to communicate with said cavity;

a movable piston arranged in said cavity;

means for providing reciprocating motion to said piston;

a source of sealant arranged to communicate with said cavity, the movement of said piston drawing said sealant into said cavity when said piston moves in a first direction and forcing said sealant into and through said injecting and penetrating element when said piston moves in a second, opposite direction; and, a source of pressurized gas connected to said housing and communicating with said injecting and penetrating element when said piston has moved a predetermined distance in said second direction.

9. The apparatus as set forth in claim 8 and check valve means permitting the flow of sealant into said cavity and preventing the flow thereof back to said source.

10. The apparatus as set forth in claim 8 and said sealant being delivered to said injecting and penetrating means during the movement of said piston to said predetermined distance.

11. The apparatus set forth in claim 8 and means for compressing the ball prior to the introduction of said sealant to create a negative pressure therein.

12. The apparatus as set forth in claim 8 and:

said injecting and penetrating element extending into said cavity;

said source of pressurized gas being connected to the interior of said piston;

a passage arranged through said piston to receive said injecting and penetrating element therein to communicate with said pressurized gas; and, a valving member arranged to normally seal said passage through said piston and being penetrable by said injecting and penetrating element for delivery of pressurized gas therethrough upon movement of said piston said predetermined distance in said first direction.

* * * * *